US009175430B2

(12) United States Patent
Hasanreisoglu et al.

(10) Patent No.: US 9,175,430 B2
(45) Date of Patent: Nov. 3, 2015

(54) WASHING MACHINE WHEREIN THE UNBALANCED LOAD IS BALANCED

(75) Inventors: Ali Levent Hasanreisoglu, Istanbul (TR); Ersin Donmez, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 372 days.

(21) Appl. No.: 13/699,282

(22) PCT Filed: May 13, 2011

(86) PCT No.: PCT/EP2011/057803

§ 371 (c)(1),
(2), (4) Date: Nov. 20, 2012

(87) PCT Pub. No.: WO2011/144539

PCT Pub. Date: Nov. 24, 2011

(65) Prior Publication Data

US 2013/0061638 A1 Mar. 14, 2013

(30) Foreign Application Priority Data

May 20, 2010 (TR) ..... a 2010 04001

(51) Int. Cl.
*D06F 37/20* (2006.01)
*D06F 37/22* (2006.01)

(52) U.S. Cl.
CPC ..... *D06F 37/203* (2013.01); *D06F 37/225* (2013.01)

(58) Field of Classification Search
CPC ..... D06F 37/203; D06F 37/225
USPC ..... 68/12.06, 23.1, 23.2, 139, 140, 141, 68/142, 143, 144
See application file for complete search history.

(56) References Cited

U.S. PATENT DOCUMENTS

| | | | | | |
|---|---|---|---|---|---|
| 2,534,267 | A | * | 12/1950 | Kahn | 74/572.4 |
| 2,534,268 | A | * | 12/1950 | Ellner et al. | 74/572.4 |
| 2,534,269 | A | * | 12/1950 | Ellner et al. | 74/572.4 |
| RE24,140 | E | * | 4/1956 | Kahn | 74/572.4 |
| 2,975,528 | A | * | 3/1961 | Shewmon | 34/601 |
| 5,280,660 | A | * | 1/1994 | Pellerin et al. | 8/158 |
| 5,582,040 | A | * | 12/1996 | Khan | 68/23.2 |
| 6,626,014 | B2 | * | 9/2003 | Heyder et al. | 68/140 |
| 2004/0083774 | A1 | * | 5/2004 | Kinouchi et al. | 68/23.1 |
| 2011/0197462 | A1 | | 8/2011 | Hasanreisoglu | |

FOREIGN PATENT DOCUMENTS

| | | | |
|---|---|---|---|
| JP | 2002136792 | A | 5/2002 |
| WO | 2008125498 | A1 | 10/2008 |
| WO | 2010043273 | A1 | 4/2010 |

* cited by examiner

*Primary Examiner* — Joseph L Perrin
(74) *Attorney, Agent, or Firm* — Venjuris P.C.

(57) ABSTRACT

A washing machine (1) is disclosed and includes a drum (2), a tub (3) wherein the drum (2) moves, a shaft (4), a cylindrical stationary hub (5) disposed on the rear wall of the tub (3) where the shaft (4) is supported, a bearing housing (7) in the middle of the hub (5) where at least one bearing (6) bearing the shaft (4) is placed, a cylindrical hub housing (8) connected to the rear wall of the drum (2), surrounding the hub (5) concentrically such that a gap remains between the hub (5) and rotating together with the drum (2) by transferring the movement of the shaft (4) to the drum (2), at least one balancing chamber (9) disposed in the drum (2) into which water is transferred by the unbalanced load status and a water distributing device (12) mounted between the hub (5) and the hub housing (8), having more than one ring-shaped gasket (10) arranged one after the other in parallel to each other and at least one slot (11) disposed between the gaskets (10).

11 Claims, 5 Drawing Sheets

WASHING MACHINE WHEREIN THE UNBALANCED LOAD IS BALANCED

The present invention relates to a washing machine wherein the unbalanced load inside the drum is balanced by using water.

In washing machines having drums rotating around the horizontal axis, in different steps of the washing program, the washing process is performed by the drum being rotated at different speeds. While the drum is being rotated, an uneven load distribution occurs as a result of the laundry piling up at some areas. Especially in the spin-drying step wherein the drum is rotated at high speeds, the unbalanced load resulting from the laundry and structural factors increases vibration and noise, and causes the washing machine to wear out. Furthermore, the spin-drying performance of the washing machine is adversely affected.

Figure 1:
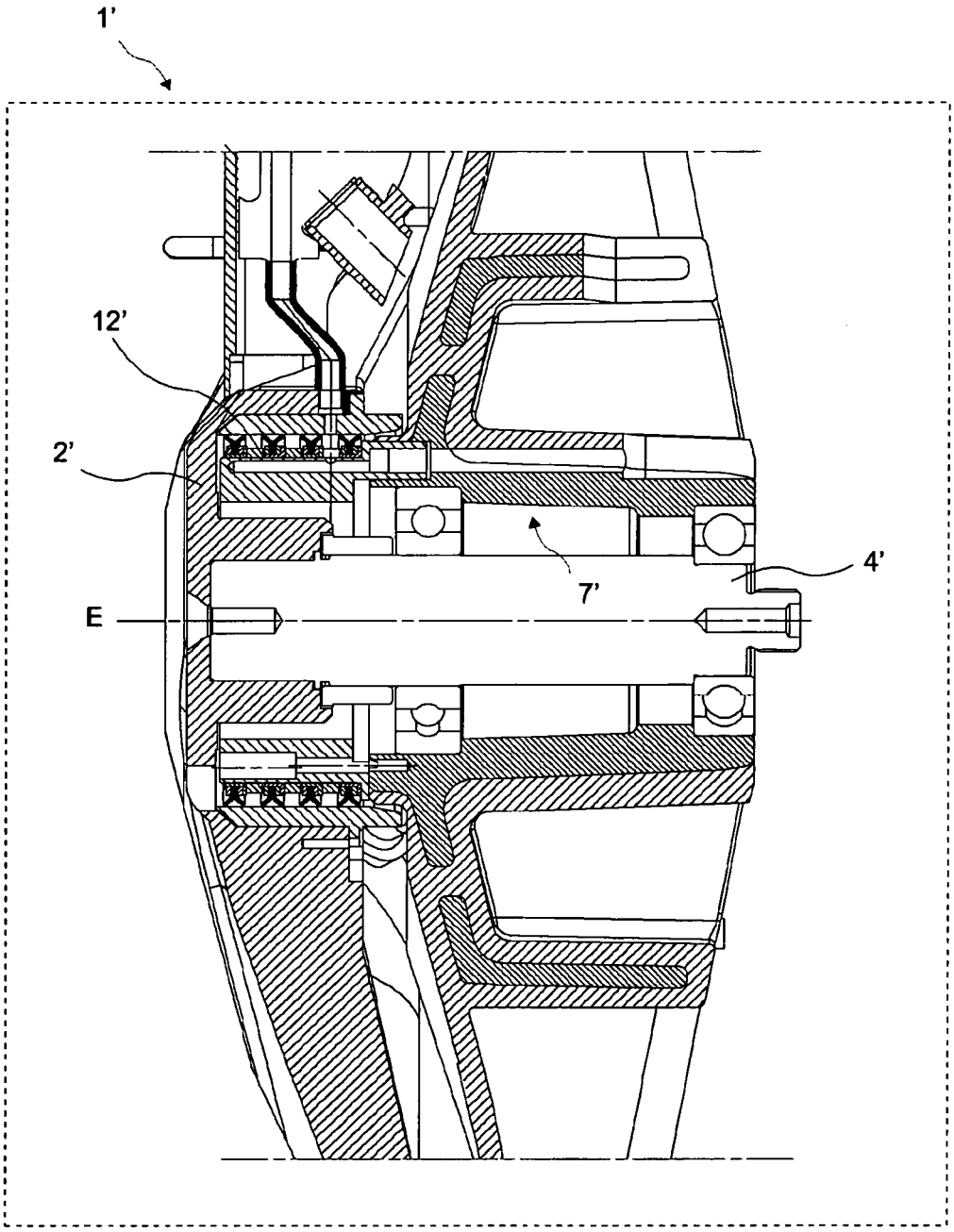
Figure 1 PRIOR ART

In the state of the art, various solutions have been developed for balancing the unbalanced load. Fixing balancing weights produced from heavy materials such as concrete or metal onto the tub of the washing machine is a commonly used method. Since the balancing weights make the transportation of the washing machine difficult, water is used to realize the balancing operation in some embodiments. Water is filled into the balancing chambers formed on the tub or the drum in order to balance the detected unbalanced load, and emptied when the unbalanced load is eliminated. Using water to balance the unbalanced load also causes some problems. Particularly, since a significant number of materials and sealing elements are needed to be used in order to transfer water to the areas wherein balancing process will be performed, cost increases, moreover since elements used covers much space inside the washing machine, laundry loading capacity may decrease. In some of the state of the art embodiments, water taken from the outside for the balancing process is generally transferred to the balancing chambers on the drum baffles by being passed through the hub of the drum and of the tub where the shaft rotating the drum is borne. Water taken from the mains is distributed to the balancing chambers by means of a water distributing device placed at the hub portion where the shaft rotating the drum is borne and composed of the ring-shaped gaskets arranged one after the other and the water passage slots between the gaskets. There is not much distance between the drum and the tub at the hub region where the shaft is borne in the axial direction and the placement of the water distributing device causes a problem due to its length. When the water distributing device is placed as extending towards the outside of the tub, the volume of the outer body of the washing machine needs to be increased, when the water distributing device is placed inside the drum, this time the volume in the drum wherein the laundry is placed decreases. In the state of the art washing machine (1') wherein the unbalanced load is balanced by using water, since the water distributing device (12') and the bearing housing (7') where the shaft (4') rotating the drum (2') are placed so as to be end to end, they occupy a space as much as the total of the lengths of both elements and cause the volume in the drum (2') to narrow (FIG. 1).

In state of the art Japanese Patent Application No. JP2002136792, an additional grooved element is described which bears against the shaft bearing and which provides water to be transferred to the baffles on the drum by being directed when there is unbalanced load. The said grooved element is outside the tub.

In the state of the art International Patent Application No. WO2008/125498, delivering water to the baffles in the drum over the bearing wherein the drum shaft is borne for balancing is explained.

The aim of the present invention is the realization of a washing machine wherein elements providing the unbalanced load in the drum to be balanced by using water occupy less space.

The washing machine realized in order to attain the aim of the present invention, explicated in the first claim and the respective claims thereof comprises a cylindrical hub housing extending from the rear wall of the drum into the drum in the axial direction and rotating together with the drum and a hub extending from the tub into the hub housing, thus into the drum and bearing the shaft rotating the drum, and a water distributing device providing the unbalanced load to be balanced with water and composed of the sealing gaskets and slots is placed between the hub housing and the hub extending into the drum. The bearing housing placed in the middle of the hub and bearing the shaft extends into the drum so as to be one within the other with the hub housing, the hub and the water distributing device and thereby the shaft is supported within the drum and the hub housing surrounds the water distributing device, the hub, the bearing housing and the shaft in the drum region totally.

In an embodiment of the present invention, two bearings are placed in the bearing housing with a certain distance between the bearings in order to provide desired strength conditions and the water distributing device is mounted outside the hub, aligned with the empty region between the two bearings in the bearing housing so as to at least partially surround this region in the axial direction.

In another embodiment of the present invention, one of the bearings is placed in the portion of the bearing housing extending into the drum and the other in the portion of the bearing housing aligned with the rear wall of the tub.

In another embodiment of the present invention, the water distributing device is placed on the outer surface of the hub so as to completely surround at least one bearing in the bearing housing.

In another embodiment of the present invention, the water distributing device completely surrounds one of the bearings and the oil gasket adjacent to this bearing at the outer surface of the hub.

In another embodiment of the present invention, the water distributing device is placed on the outer surface of the hub so as to completely surround the bearings and the part between the bearings.

In the washing machine of the present invention, the water distributing device and the bearing housing that cause a problem when placed end to end at the drum-tub hub region due to their lengths are provided to occupy less space by being placed one within the other, the dimensions of the washing machine body is not required to be increased, the laundry capacity of the drum is increased by decreasing the space that they occupy.

The washing machine realized in order to attain the aim of the present invention is illustrated in the attached figures, where:

FIG. 1—is the detailed view of a drum, a tub, a water distributing device rotating with the drum and a bearing housing disposed on the tub hub in a state of the art washing machine wherein the unbalanced load is balanced.

Figure 2:
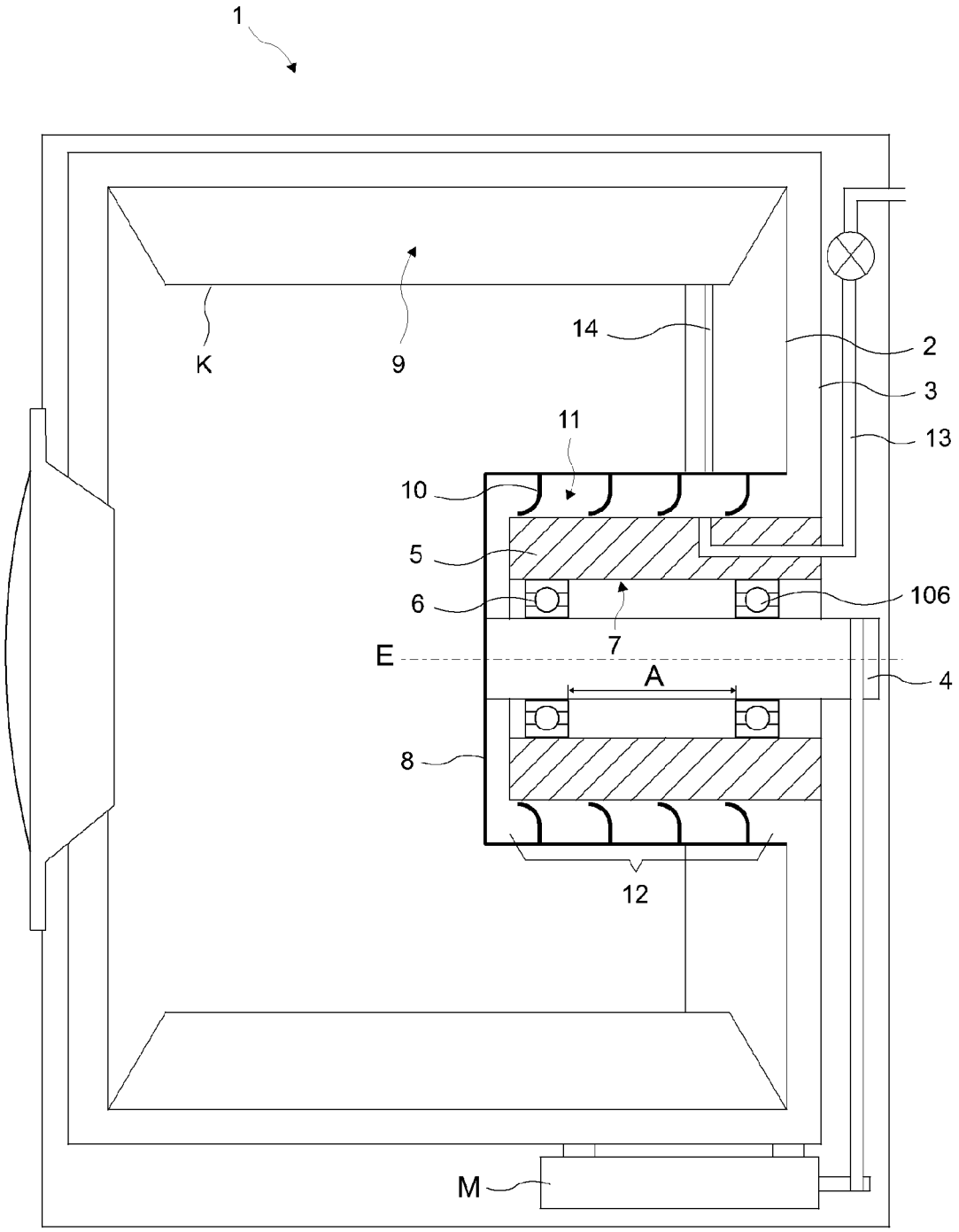

FIG. 2—is the schematic view of the washing machine of the present invention.

Figure 3:
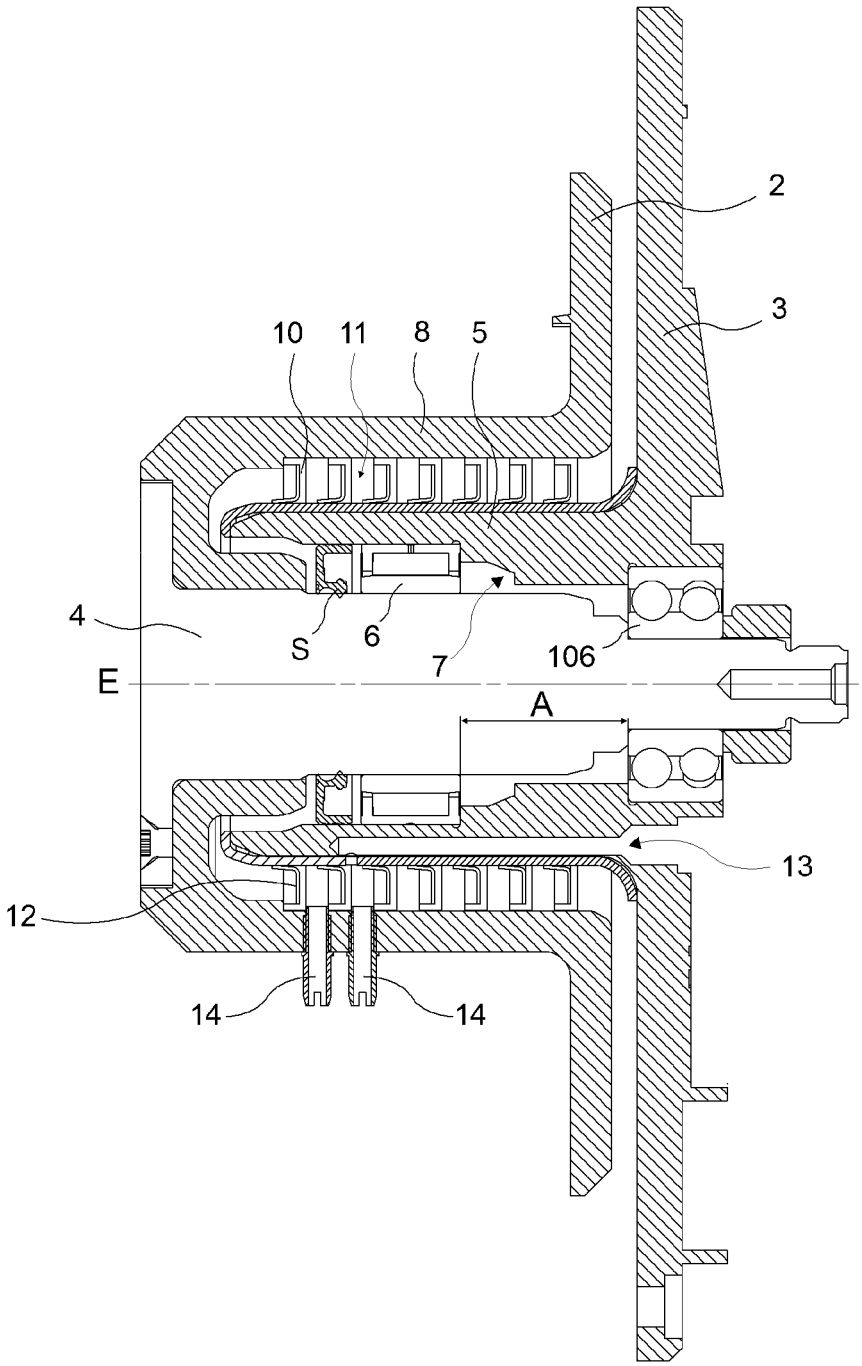

FIG. 3—is the cross-sectional view of a hub housing disposed in the drum of the washing machine of the present invention, a hub disposed in the tub, a water distributing device and a bearing housing.

Figure 4:
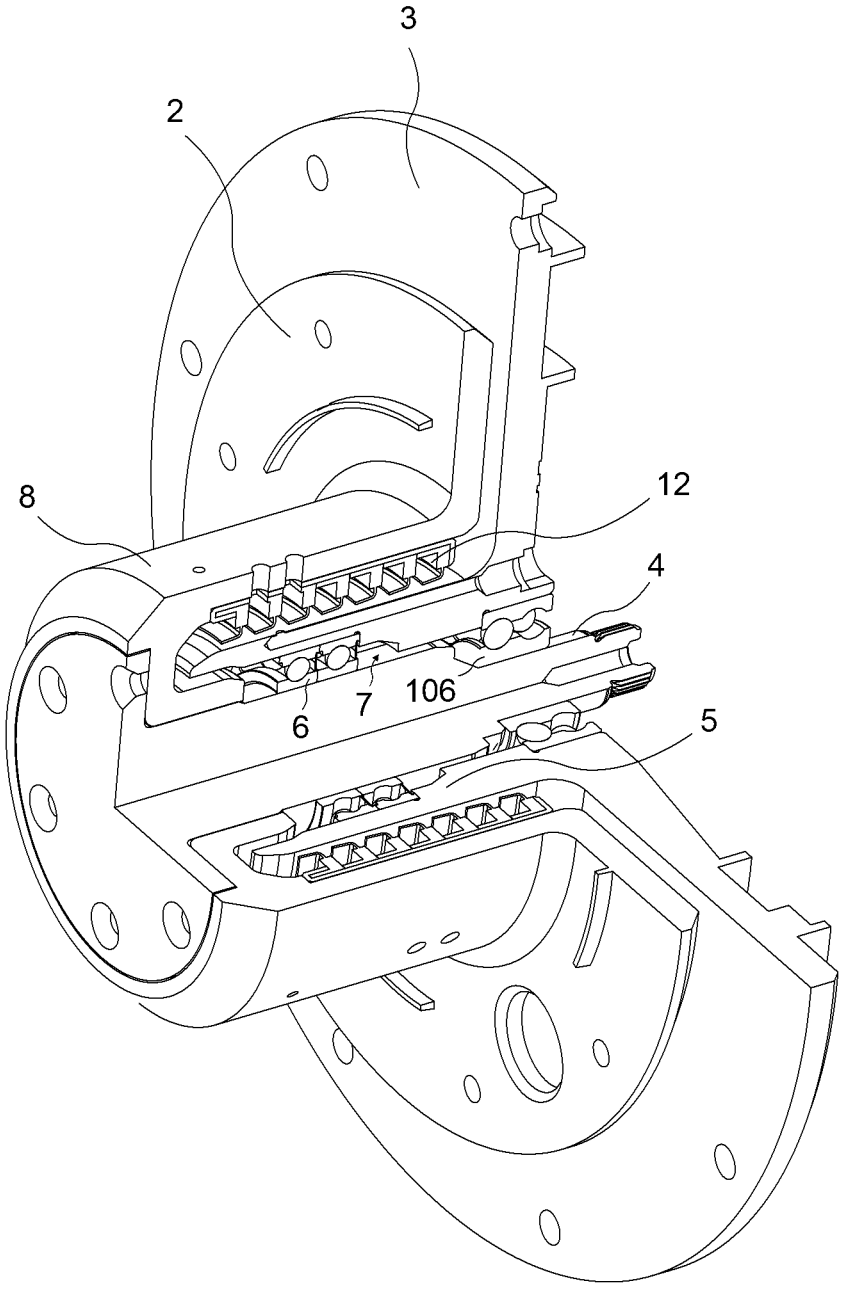

FIG. 4—is the partial cross-sectional perspective view of the hub housing, the hub, the water distributing device, the bearing housing and the shaft.

Figure 5:
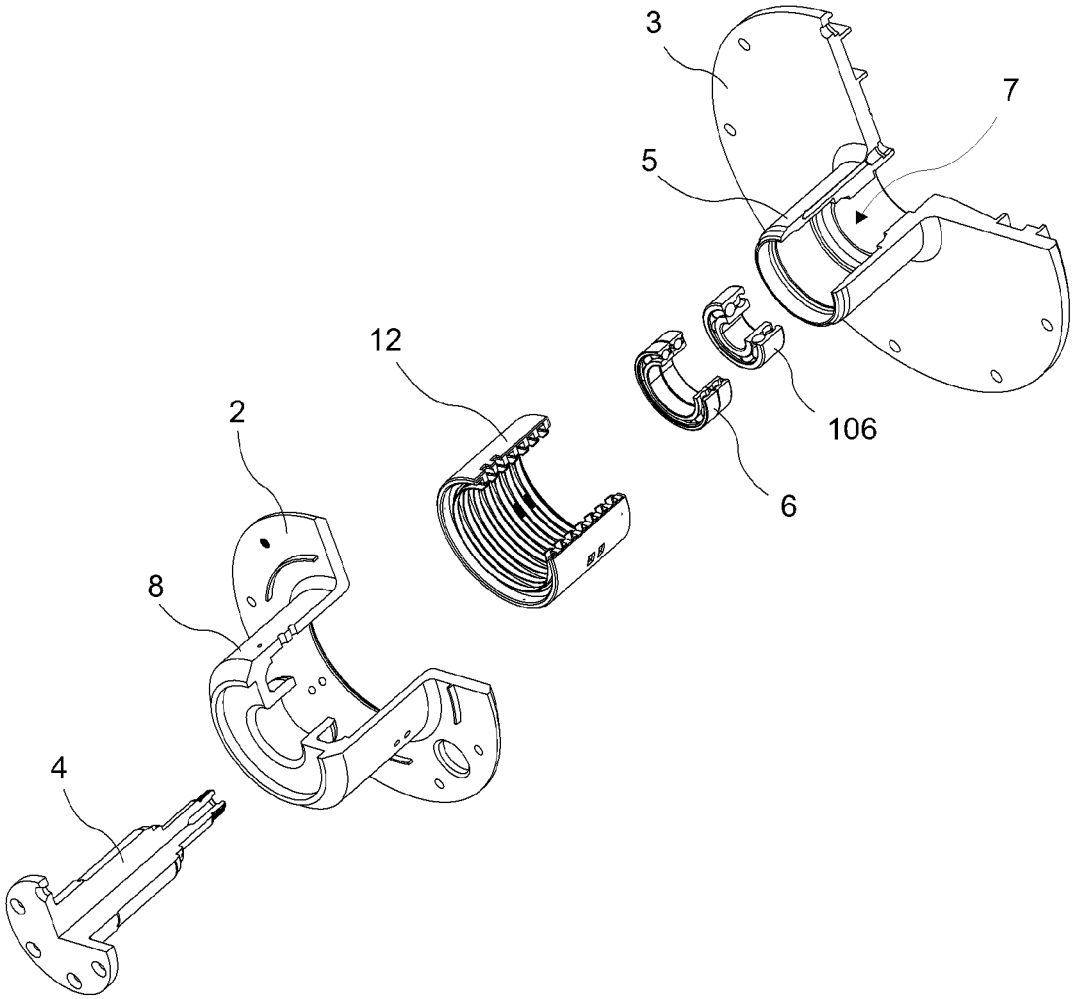

FIG. 5—is the partial cross-sectional exploded view of the hub housing, the hub, the water distributing device, the bearing housing and the shaft.

The elements illustrated in the figures are numbered as follows:

1. Washing machine
2. Drum
3. Tub
4. Shaft
5. Hub
6. 106 Bearing
7. Bearing Housing
8. Hub housing
9. Balancing chamber
10. Gasket
11. Slot
12. Water distributing device
13. Water inlet line
14. Water outlet line The washing machine (1) comprises a drum (2) rotated by a motor (M) around the horizontal axis (E), wherein the laundry is placed, a tub (3) wherein the drum (2) moves, a shaft (4) that transfers the movement received from the motor (M) to the drum (2), a cylindrical stationary hub (5) disposed on the rear wall of the tub (3) and wherein the shaft (4) is supported, a bearing housing (7) disposed in the middle of the hub (5) and wherein more than one bearing (6, 106) support the shaft (4) is placed, a cylindrical hub housing (8) connected to the rear wall of the drum (2), surrounding the hub (5) concentrically such that a gap remains between the hub housing (8) and the hub (5) and rotating together with the drum (2) by transferring the movement of the shaft (4) to the drum (2), at least one balancing chamber (9) disposed in the drum (2) and into which water is transferred according to the unbalanced load status, preferably disposed in the drum (2) baffles (K), a water distributing device (12) placed between the outer surface of the hub (5) and the inner surface of the hub housing (8), having more than one ring-shaped gasket (10) arranged one after the other in parallel to each other and at least one slot (11) disposed between the gaskets (10), at least one water inlet line (13) providing water taken from outside to be transferred to the slots (11) and at least one water outlet line (14) providing water filling into the slots (11) to be transferred to the balancing chambers (9).

The washing machine (1) of the present invention comprises,

- the hub housing (8) extending from the rear wall of the drum (2) into the drum (2) in the axial direction (E),
- the hub (5) extending from the rear wall of the tub (3) into the region that the hub housing (8) surrounds in the drum (2) by passing through the plane that the rear wall of the drum (2), and
- the said hub housing (8) that surrounds the water distributing device (12), the hub (5), the bearing housing (7) and the shaft (4) altogether in the drum (2) region concentrically.

In the washing machine (1), the bearing housing (7) that extends along the hub (5) in the axial direction (E) in the middle of the hub (5) and that surrounds the shaft (4) at the portion of the hub (5) extending into the drum (2) in a concentric manner and one within the other with the hub housing (8) and the water distributing device (12) (FIG. 2, FIG. 3).

The rotary hub housing (8) connected to the drum (2) and the stationary hub (5) connected to the tub (3) extend from the rear wall of the drum (2) into the drum (2) concentrically and one within the other. The water distributing device (12) is placed between the inner surface of the hub housing (8) and the outer surface of the hub (5) concentric with the hub housing (8) and the hub (5). The bearing housing (7) is at the inner side of the portion of the hub (5) extending into the drum (2) and the water distributing device (12) is at the outer side of the portion of the hub (5) extending into the drum (2). The water distributing device (12) is at a certain length in the axial direction (E) depending on the dimensions of the gaskets (10) used and of the slots (11) between the gaskets (10). The bearing housing (7) is also at a certain length in the axial direction (E) between the bearings (6, 106) used for bearing the shaft (4) depending on the distance determined according to the strength conditions. Since the water distributing device (12) and the bearing housing (7) cause a problem in the washing machine (1) when positioned end to end, they are positioned inside and outside the hub (5) and one within the other and occupy space as much as only the length of the bearing housing (7) or only the length of the water distributing device (12) in the axial direction (E).

In an embodiment of the present invention, two bearings (6, 106) with a certain distance (A) between them are placed in the bearing housing (7) in order to provide desired strength conditions and the water distributing device (12) at least partially surrounds the outer surface of the hub (5) corresponding to between the bearings (6, 106) and the bearings (6, 106) in the axial direction (E) (FIG. 2).

In another embodiment of the present invention, the first bearing (6) is placed in the portion of the bearing housing (7) extending into the drum (2) and the second bearing (106) in the portion of the bearing housing (7) aligning with the rear wall of the tub (3) (FIG. 3).

In another embodiment of the present invention, the water distributing device (12) is placed on the outer surface of the hub (5) so as to completely surround at least one bearing (6, 106) in the bearing housing (7) (FIG. 3).

In another embodiment of the present invention, the water distributing device (12) completely surrounds the first bearing (6) and the oil gasket (S) adjacent to the first bearing (6) at the outer surface of the hub (5) (FIG. 3).

In another embodiment of the present invention, the water distributing device (12) is placed onto the outer surface of the hub (5) so as to completely surround the bearings (6, 106) and the part between the bearings (6, 106) (FIG. 2).

In the washing machine (1) of the present invention, the water distributing device (12) and the bearing housing (7), the positioning of which causes a problem since the lengths thereof in the axial direction (E) are excessive, occupy space only in the drum (2) together with the hub housing (8) and the hub (5). Since the water distributing device (12) and the bearing housing (7) does not protrude towards the outside of the drum (2) and the tub (3), the dimensions of the outer body of the washing machine (1) do not need to be increased. Since the water distributing device (12) and the bearing housing (7) are placed one within the other at the portion of the hub housing (8) and of the hub (5) extending into the drum (2), the space that they occupy in the inner portion of the drum (2) in the axial direction (E) is decreased, and the inner volume of the drum (2) and thus the laundry loading capacity are increased.

It is to be understood that the present invention is not limited by the embodiments disclosed above and a person skilled in the art can easily introduce different embodiments. These should be considered within the scope of the protection disclosed by the claims of the present invention.

The invention claimed is:

1. A washing machine (1) comprising:

a drum (2) rotated by a motor (M) around the horizontal axis (E) wherein the laundry is placed, a tub (3) wherein the drum (2) moves a shaft (4) that transfers the movement received from the motor (M) to the drum (2), a cylindrical stationary hub (5) disposed on the rear wall of the tub (3) and wherein the shaft (4) is supported, a bearing housing (7) disposed in the middle of the hub (5) and wherein a first bearing and a second bearing (6, 106) that supports the shaft (4) is placed, a cylindrical hub housing (8) connected to the rear wall of the drum (2), surrounding the hub (5) concentrically such that a gap remains between hub housing (8) and the hub (5) and rotating together with the drum (2) by transferring the movement of the shaft (4) to the drum (2), at least one balancing chamber (9) disposed in the drum (2) and into which water is transferred according to the unbalanced load status, a water distributing device (12) placed between the outer surface of the hub (5) and the inner surface of the hub housing (8), having more than one ring-shaped gasket (10) arranged one after the other in parallel to each other and at least one slot (11) disposed between the gaskets (10), the hub housing (8) extending from the rear wall of the drum (2) into the drum (2) in the axial direction (E), and wherein the hub (5) extending from the rear wall of the tub (3) into region that the hub housing (8) in the drum (2) by passing through the rear wall plane of the drum (2), and the hub housing (8) surrounds the water distributing device (12), the hub (5), the bearing housing (7) and the shaft (4) in the drum (2) region.

2. The washing machine (1) as in claim 1, wherein the bearing housing (7) into which two bearings (6, 106) with a certain distance (A) between the bearings (6, 106) are placed in order to provide desired strength conditions and the water distributing device (12) at least partially surrounds the outer surface of the hub (5) corresponding to between the bearings (6, 106) and the bearings (6, 106) in the axial direction (E).

3. The washing machine (1) as in claim 1 or 2, wherein the first bearing (6) placed in the portion of the bearing housing (7) extending into the drum (2) and the second bearing (106) placed in the portion of the bearing housing (7) aligning with the rear wall of the tub (3).

4. The washing machine (1) as in claim 3, wherein the water distributing device (12) placed on the outer surface of the hub (5) completely surrounds at least one bearing (6, 106) in the beating housing (7).

5. The washing machine (1) as in claim 3, wherein the water distributing device (12) placed on the outer surface of the hub (5) completely surrounds the first bearing (6) and an oil gasket (S) adjacent to the first bearing (6).

6. The washing machine (1) as in claim 3, wherein the water distributing device (12) placed on the outer surface of the hub (5) completely surrounds the bearings (6, 106) and the portion between the bearings (6, 106).

7. The washing machine (1) as in claim 1 or 2 wherein the water distributing device (12) placed on the outer surface of the hub (5) completely surrounds at least one bearing (6, 106) in the bearing housing (7).

8. The washing machine (1) as in claim 7, wherein the water distributing device (12) placed on the outer surface of the hub (5) completely surrounds the first bearing (6) and an oil gasket (S) adjacent to the first bearing (6).

9. The washing machine (1) as in claim 7, wherein the water distributing device (12) placed on the outer surface of the hub (5) completely surrounds the bearings (6, 106) and the portion between the bearings (6, 106).

10. The washing machine (1) as in claim 1 or 2 wherein the water distributing device (12) placed on the outer surface of the hub (5) completely surrounds the first bearing (6) and an oil gasket (S) adjacent to the first bearing (6).

11. The washing machine (1) as in claim 1 or 2 wherein the water distributing device (12) placed on the outer surface of the hub (5) completely surrounds the bearings (6, 106) and the portion between the beatings (6, 106).

* * * * *